US007316116B2

(12) United States Patent
Adle

(10) Patent No.: US 7,316,116 B2
(45) Date of Patent: Jan. 8, 2008

(54) FLYWHEEL COMBUSTION ENGINE

(76) Inventor: Donald L. Adle, 29510 Greenboro, Farmington Hills, MI (US) 48334

( * ) Notice: Subject to any disclaimer, the term of this patent is extended or adjusted under 35 U.S.C. 154(b) by 0 days.

(21) Appl. No.: 10/367,056

(22) Filed: Feb. 14, 2003

(65) Prior Publication Data

US 2005/0072150 A1 Apr. 7, 2005

(51) Int. Cl.
*F02B 71/04* (2006.01)

(52) U.S. Cl. ..... 60/595; 123/46 R

(58) Field of Classification Search ..... 66/595, 66/596; 123/46 R, 46 B
See application file for complete search history.

(56) References Cited

U.S. PATENT DOCUMENTS

| | | | | |
|---|---|---|---|---|
| 1,802,881 | A | 4/1931 | Dainton | |
| 3,068,639 | A | 12/1962 | Benoit | |
| 3,757,515 | A * | 9/1973 | Pais | 60/595 |
| 3,978,827 | A * | 9/1976 | Wallis | 123/46 R |
| 4,344,288 | A * | 8/1982 | Heaton | 60/595 |
| 4,403,577 | A | 9/1983 | Benaroya | |
| 4,449,488 | A | 5/1984 | Heaton | |
| 4,561,252 | A | 12/1985 | David | |
| 4,733,534 | A * | 3/1988 | Southard | 60/595 |
| 4,848,282 | A | 7/1989 | Chaneac | |
| 4,920,928 | A | 5/1990 | Hammett | |
| 4,951,618 | A | 8/1990 | Wilson | |
| 5,036,667 | A * | 8/1991 | Thatcher | 60/595 |
| 5,678,522 | A | 10/1997 | Han | |
| 6,205,961 | B1 | 3/2001 | Bailey et al. | |
| 6,293,231 | B1 | 9/2001 | Valentin | |
| 6,449,940 | B2 | 9/2002 | Nagel | |
| 6,450,846 | B2 | 9/2002 | Morikami | |

* cited by examiner

*Primary Examiner*—Hoang Nguyen
(74) *Attorney, Agent, or Firm*—Sheryln Adle

(57) ABSTRACT

A free piston drive combustion engine is provided wherein the piston are reciprocated by the force of combustion in combination with its compressed exhaust gases. A compressed air fuel mixture is ignited in the combustion chamber exploding driving a piston backward, while expelling a blast of exploding gases into an open area in the side of a turbine wheel, forcing it to rotating in a rotary motion. The compressed exhaust gases is carry within the turbine wheel, then expelling the exhaust gases into the bottom of engine and driving the piston forward. The compressed exhaust gases closes a door onto an opening in the combustion chamber and with the forward movement of the piston this would compressed air fuel mixture, therefore commence the combustion-exhaust cycle thereat. Before any exhaust is expel from the engine, it help to drive piston forward and help to closed door onto combustion chamber opening therefore helping compressing incoming air fuel mixture.

19 Claims, 6 Drawing Sheets

FLYWHEEL COMBUSTION ENGINE

CROSS-REFERENCE TO RELATED APPLICATIONS

Not applicable.

REFERENCE TO MICROFICHE APPENDIX

Not applicable.

CROSS REFERENCE TO RELATED APPLICATIONS

Dainton device (U.S. Pat. No. 1,802,881 issued April 1931).

Benoit device (U.S. Pat. No. 3,068,639 issued September 1961).

Pais device (U.S. Pat. No. 3,757,515 issued September 1973).

Wallis device (U.S. Pat. No. 3,978,827 issued September 1976).

Heaton device (U.S. Pat. No. 4,344,288 issued August 1982).

Benaroya device (U.S. Pat. No. 4,403,577 issued September 1983).

Southard device (U.S. Pat. No. 4,733,534 issued March 1988).

Heaton device (U.S. Pat. No. 4,449,488 issued May 1984).

David device (U.S. Pat. No. 4,561,252 issued December 1985).

Chaneac device (U.S. Pat. No. 4,848,282 issued July 1989).

Hammett device (U.S. Pat. No. 4,920,928 issued May 1990).

Wilson device (U.S. Pat. No. 4,951,618 issued August 1990).

Han device (U.S. Pat. No. 5,036,667 issued August 1991).

Han device (U.S. Pat. No. 5,678,522 issued October 1997).

Bailey device (U.S. Pat. No. 6,205,961 issued March 2001).

Valentin device (U.S. Pat. No. 6,293,231 issued September 2001).

Young device (U.S. Pat. No. 6,408,717 issued June 2002).

Nagel device (U.S. Pat. No. 6,449,940 issued September 2002).

Morikami device (U.S. Pat. No. 6,450,846 issued September 2002).

STATEMENT REGARDING FEDERALLY SPONSORED RESEARCH OR DEVELOPMENT

Not applicable.

REFERENCE TO SEQUENCE LISTING, A TABLE, OR A COMPUTER PROGRAM LISTING APPENDIX

Not applicable.

BACKGROUND OF INVENTION

1. This Invention relates generally to the free-piston type internal combustion engine that is connected to a turbine wheel. Particular to innovations which improve controllability and efficiency of the free-piston engine by using a turbine wheel. Using a turbine wheel along with a free moving piston, this will reduce toxic emissions, weight and size of such engines.

2. Turbine wheel is a rotation wheel used to minimize variations in angular velocity and revolutions per minute. Using a combustion chamber along with a turbine wheel in the use of fuel or propellant that is initiated and controlled would transmit power to the turbine wheel. This would take advantage of bypassing the use of having a crankshaft.
3. There is an advantageous application, by using a turbine wheel along with its combustion gases in transmitting energy. Simple concept of free-piston internal combustion engines is transferring combustion energy direct into mechanical energy.
4. Invention is directed to an internal combustion engine, which is well known. There are engines with a combustion chamber that are with its piston and rod rigidly attached to the crankshaft. Free-piston engine moves freely and independently of main shaft of the engine. Advantages of a free-piston engine that its piston not being rigidly attached to a crankshaft connected by a rod.
5. Free-piston internal-combustion engines having a cylinder and one or more reciprocation pistons therein. One piston at least of which is movable freely and independently of the main shaft. Engine on the stroke of such piston immediately following ignition of the charge. Burned gases during which stroke the energy is stored. Energy is thereafter transferred to main shaft of the engine. Energy is ordinarily stored by forcing piston against pressure of the atmosphere. Therefor stored energy is ordinarily transferred to the main shaft by securing piston thereto by means of a suitable clutch. Such energy provided with suitable converting mechanism upon its return stroke.
6. Cylinder of an internal-combustion engine is closed at one end by a plate called a head and open at the other end. Permitting free oscillation of the connection rod, which joins piston to crankshaft.
7. Internal-combustion engine, fuel-air mixture is burned in the engine proper. Hot gaseous products of combustion act directly on the surfaces of its moving parts, such as those of pistons.
8. Turbine wheel is a wheel attached to a rotating shaft, which the kinetic energy of a moving exhaust gases is converted to mechanical power by the impulse or reaction of the gases with a series of notch or fagged cut arrayed about the circumference of the turbine wheel.
9. Turbine wheel is a wheel smoothing out delivery of power from a motor to a machine. Inertia of the turbine wheel opposes and moderates fluctuations in speed of engine. Turbine wheel stores the excess energy for intermittent use and smoothes out pulses of energy provided by combustion.

BRIEF SUMMARY OF THE INVENTION

The present invention substantially departs from conventional concepts and designs of prior art. Providing for a flywheel combustion engine 10, utilizing a combustion chamber 28 mounted around the periphery of a turbine wheel 20, enclosed within said flywheel combustion engine 10, with said combustion chamber 28 communicating at the combustion and thereof with said turbine wheel 20. A cylinder 58 utilizing said combustion chamber 28, a upper piston 60, a lower piston 68 with a rod 66 connecting said pistons 60, 68 with a cylinder in-between area 78 between said pistons 60, 68, axially slid ably mounted therein, to reciprocate between the combustion end and gas exhaust flow end of said cylinder 58. A upper engine open area 12 utilizing a head door 46 in proximity periphery with said turbine wheel 20, with a turbine wheel open area 24 receiving exploding gases within said combustion chamber 28, therefore said exploding gases expelling and compressed into said turbine wheel open area 24, concurrently rotating said turbine wheel 20.

With said pistons 60, 68 advancing forward toward said combustion chamber 28 within said cylinder 58, and feeding air-fuel mixture into said combustion chamber 28 at the combustion end thereof. Compressing and Igniting said mixture to drive said pistons 60, 68 backward toward a cylinder bottom area 80, with said exploding gases expelling toward said head door 46 end of said combustion chamber 28. With said exploding gases therefore opening said head door 46 and expelling said exploding gases into said upper engine open area 12, and against said turbine wheel 20. Said exploding gases pushes open said head door 46 by said exploding gases, sequence driving of said turbine wheel 20 in a rotary motion.

Said exploding gases expelling into said turbine wheel open area 24, from said upper engine open area 12 therefore concurrently rotating said turbine wheel 20 in a rotary motion.

Said exploding gases now would be turning into compressed exhaust gases. Said turbine wheel open area 24 in a rotary motion with said compressed exhaust gases within expelling into a lower engine area 18, then said compressed exhaust gases expelling into a door ba-line 52 within said head door 46. Said compressed exhaust gases expelling out said door ba-line 52, then said compressed exhaust gases expelling into said upper engine open area 12, bushing and closing said head door 46 on top of a combustion chamber outlet opening 34, of said combustion chamber 28.

Said exploding gases pushing said pistons 60, 68 downward toward said lower engine area 18, this would be helping closing said head door 46 by pushing some of said compressed exhaust gases in said lower engine area 18 into a head door aa-line 38, than pushing said expelling compressed exhaust gases into said door ba-line 52, then pushing said compressed exhaust gases out into said upper engine open area 12, therefore said compressed exhaust gases would be helping to close said head door 46.

Said compressed exhaust gases within said lower engine area 18 expelling into said cylinder bottom area 80, pushing of said pistons 60, 68 forward movement toward said combustion chamber 28, then expelling said compressed exhaust gases into a bore inlet opening 86, then expelling said compressed exhaust gases a bore line 88, then expelling said compressed exhaust gases into said cylinder in-between area 78. Said pistons 60, 68 forward movements open up a bore outlet opening 90.

At the same time said bore inlet opening 86 is opening up into said bore line 88, also opening said bore outlet opening 90 into said cylinder in-between area 78, at the same time closing off a exhaust line inlet opening 92 of said a exhaust line 94.

Said backward movement of said pistons 60, 68 toward said lower engine area 18, closing off said bore line 88 and said bore outlet opening 90, therefore opening up said exhaust line 94 within said cylinder in-between area 78, than said compressed exhaust gases expelling into said exhaust line 94, then expelling out a exhaust line outlet opening 96 commencing said combustion exhaust cycle thereat. Provided an automatic cycle, self timing, exhaust piston drive, said flywheel combustion engine 10, and more fully described the here-in after.

Further objects and advantages of my invention will become apparent. The drawing and ensuring description will become apparent.

BRIEF DESCRIPTION OF THE DRAWING

This invention relates to apparatus and methods.

REFERENCE NUMERALS IN DRAWINGS

Figure 1:
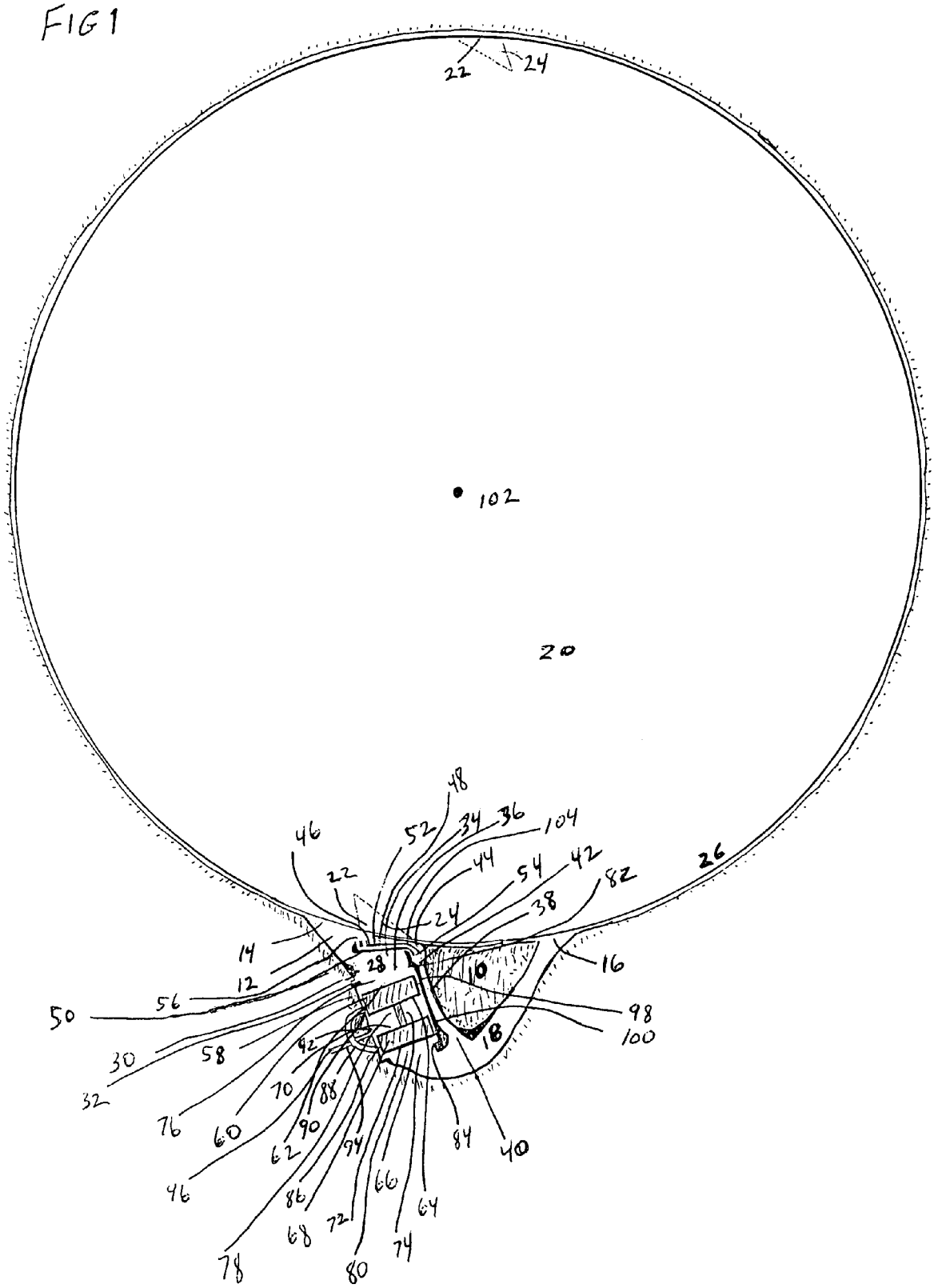
FIG. 1 is a perspective view of flywheel combustion engine. This is in accordance with principles of the present invention.
Figure 2:
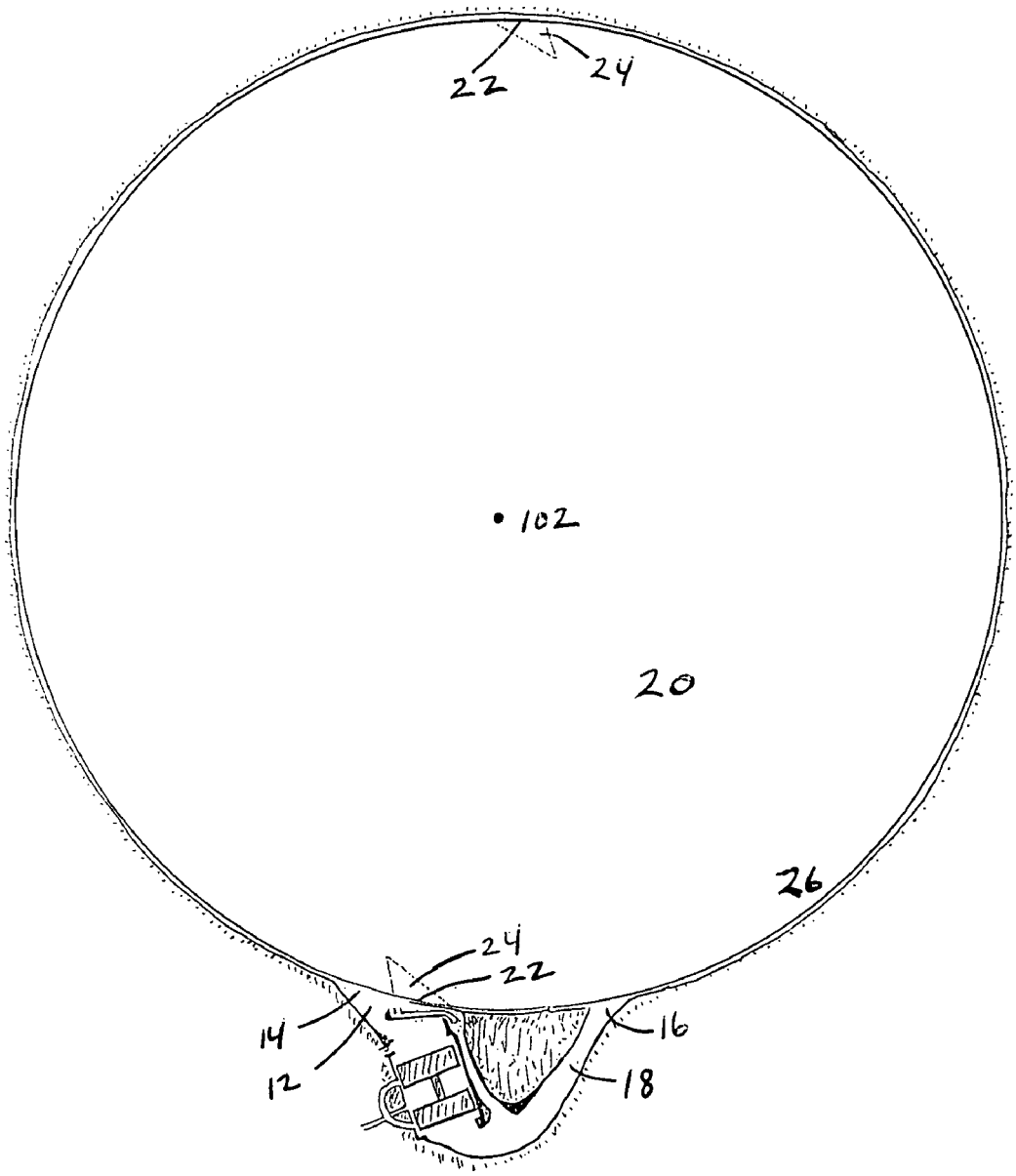
FIG. 2 is a perspective view of Turbine wheel. This is in accordance with principles of the present invention.
Figure 3:
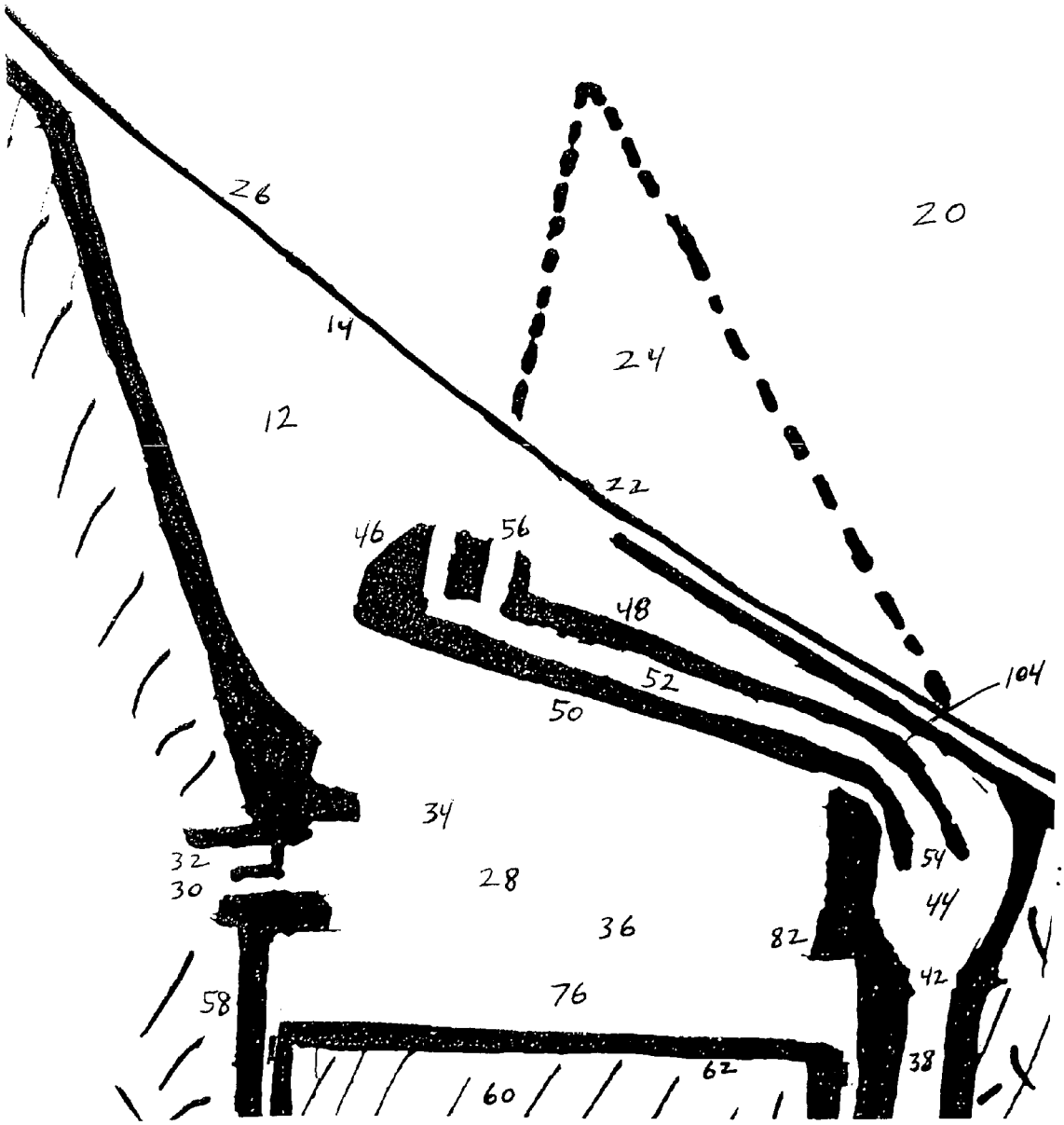
FIG. 3 is a perspective view of Combustion Chamber, Upper Engine Open Area, Head Door, Head Door Open Area. This is in accordance with principles of the present invention.
Figure 4:
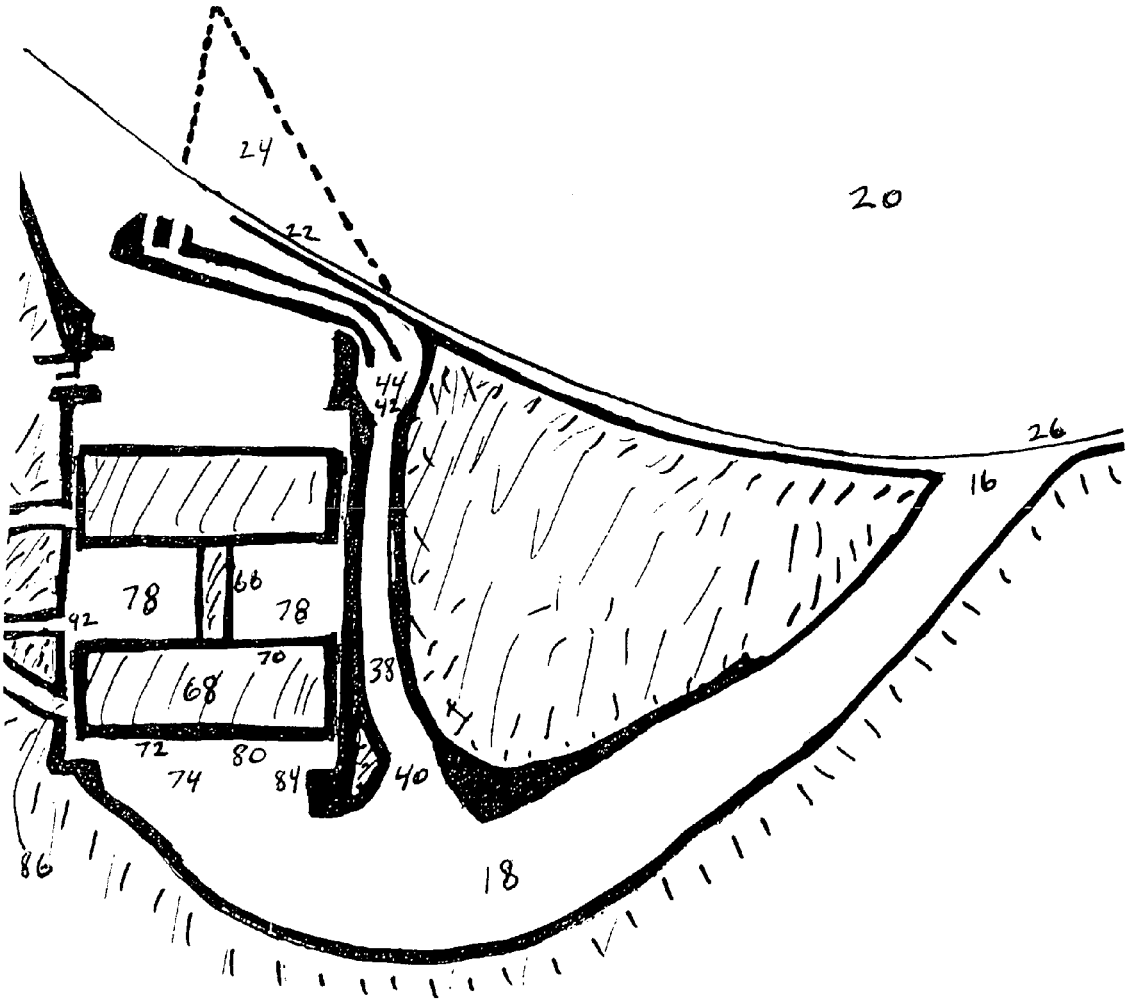
FIG. 4 is a perspective view of Lower Engine Area. This is in accordance with principles of the present invention.
Figure 5:
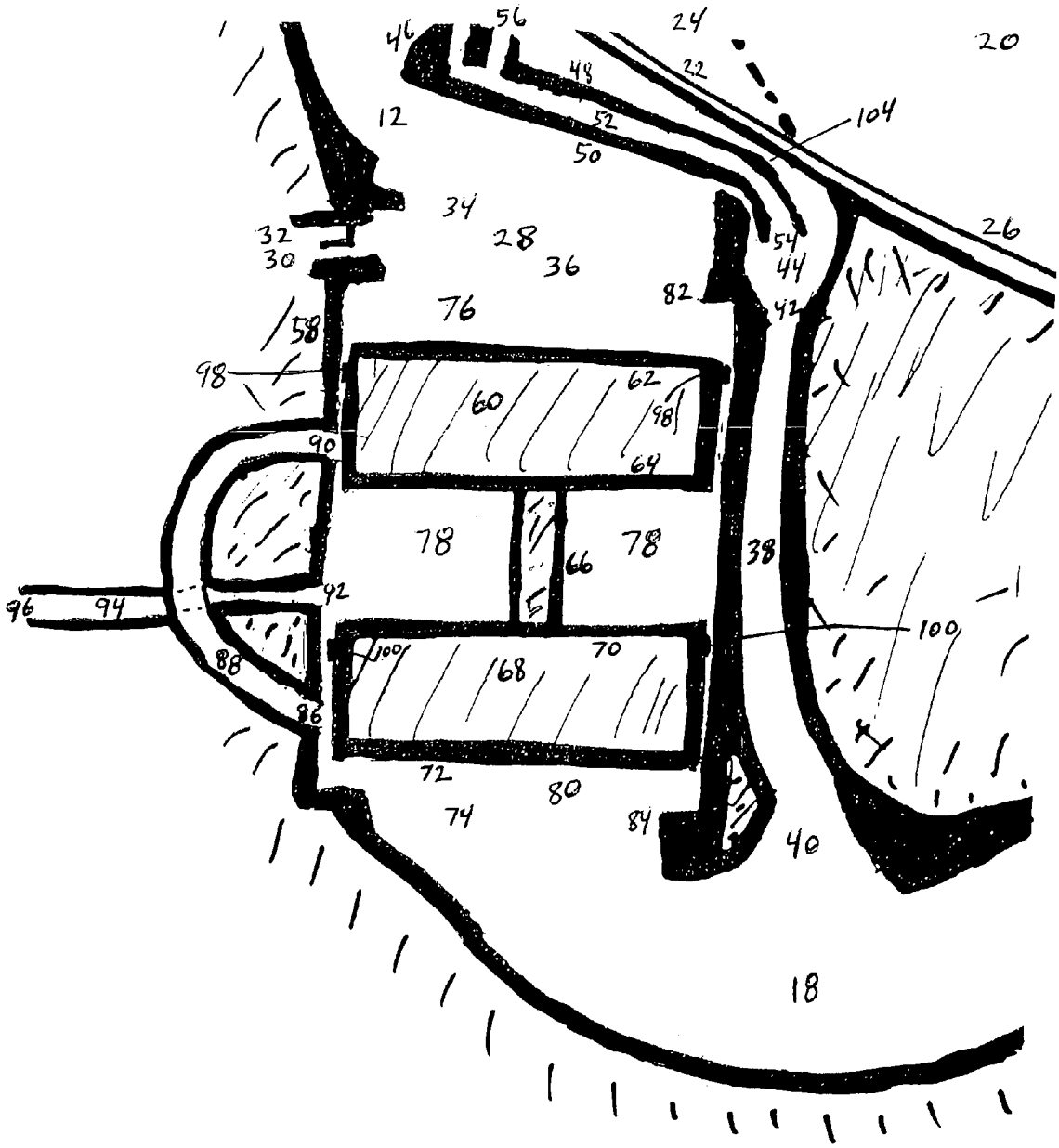
FIG. 5 is a perspective view of Cylinder, Head door aa-line, bore Line, Exhaust Line This is in accordance with principles of the present invention.
Figure 6:
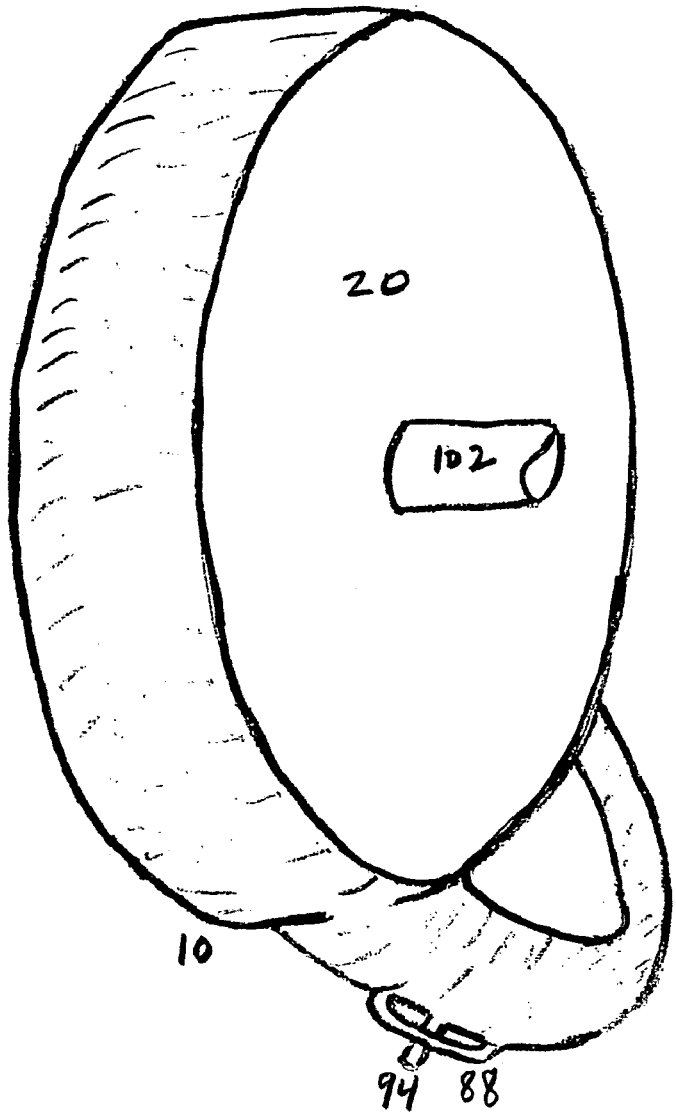
FIG. 6 is a perspective side view of flywheel combustion engine. This is in accordance with principles of the present invention.

10 flywheel combustion engine
12 upper engine open area
14 upper engine open area outlet opening
16 lower engine inlet opening
18 lower engine area
20 turbine wheel
22 turbine wheel inlet-outlet opening
24 turbine wheel open area
26 turbine wheel outer edge
28 combustion chamber
30 injector
32 spark plug
34 combustion chamber outlet opening
36 top bore outlet opening
38 head door aa-line
40 head door line inlet ab-opening
42 head door line outlet ac-opening
44 head door open area
46 head door
48 top side of head door
50 bottom side of head door
52 door ba-line
54 door line inlet bb-opening
56 door line outlet bc-opening
58 cylinder
60 upper piston
62 top side of upper piston
64 bottom side of upper piston
66 rod
68 lower piston
70 top side of lower piston
72 bottom side of lower piston
74 lwer cylinder in let-outlet opening
76 top bore area
78 cylinder in-between area
80 cylinder bottom area
82 lower side of combustion chamber

84 lower side of cylinder
86 bore inlet opening
88 bore line
90 bore outlet opening
92 exhaust line inlet opening
94 exhaust line
96 exhaust line outlet opening
98 metal ca-ring
100 metal cb-ring
102 drive shaft
104 means of controlling head door.

DETAILED DESCRIPTION

Flywheel Combustion Engine

The present description provides for said flywheel combustion engine 10 having said combustion chamber 28 mounted at the periphery of said turbine wheel 20 and enclosed within said flywheel combustion engine 10. Enclosed within said flywheel combustion engine 10 utilizing member including said cylinder 58, said upper engine open area 12, said turbine wheel 20, said lower engine area 18, said head door aa-line 38, said bore line 88. Said exhaust line 94 mounted on said cylinder 58 on said flywheel combustion engine 10. A sensor not shown mounted on said flywheel combustion engine 10.

Cylinder

Enclosed within said flywheel combustion engine 10, said cylinder 58, utilizing member including said combustion chamber 28, a injector 30, a spark plug 32, a top bore outlet opening 36 that is an opening into said combustion chamber 28 from a top bore area 76, said upper piston 60, said rod 66, said lower piston 68, said top bore area 76, said cylinder in-between area 78, said cylinder bottom area 80, said combustion chamber outlet opening 34 that is an opening into said upper engine open area 12 from said combustion chamber 28, a lower cylinder inlet-outlet opening 74 that is an opening into said lower engine area 18 from said cylinder bottom area 80 and being the same opening into said cylinder bottom area 80 from said lower engine area 18, said bore inlet opening 86 that is an opening into said bore line 88 from said cylinder bottom area 80, said bore outlet opening 90 that is an opening into said cylinder in-between area 78 from said bore line 88. Said top bore area 76 being a lower side of combustion chamber 82 this being at top side of said top bore area 76. Said cylinder bottom area 80 being a lower side of cylinder 84 this being at bottom side of said cylinder bottom area 80. Said upper piston 60 with a top side of upper piston 62 as this is being the top side of said upper piston 60. Said upper piston 60 with a bottom side of upper piston 64 this is being the bottom side of said upper piston 60. Said lower piston 68 with a top side of lower piston 70 this is being the top side of said lower piston 68. Said lower piston 68 with a bottom side of lower piston 72 this is being the bottom side of said lower piston 68. Said exhaust line 94 mounted on said cylinder 58 with said exhaust line inlet opening 92 being connected within said cylinder in-between area 78. Said upper piston 60 has a metal ca-ring 98 fitting around said upper piston 60. Said lower piston 68 has a metal cb-ring 100 fitting around said lower piston 68. Said injector 30 mounted on said cylinder 58 with said injector 30 being connected to said combustion chamber 28. A electrical fuel pumping means not shown mounted on said cylinder 58 with said electrical fuel pumping means not shown being connected to said combustion chamber 28. Said spark plug 32 mounted on said cylinder 58 with said spark plug 32 being connected to said combustion chamber 28. Said combustion chamber 28 utilizing said injector 30, said spark plug 32, said electrical fuel pumping means not shown.

Said combustion chamber 28 mounted at periphery of said upper engine open area 12, lying next to said head door 46 as closed, said head door 46 as open would be inside said upper engine open area 12. Said combustion chamber 28 that being the space between the opening of said combustion chamber outlet opening 34 and said top bore outlet opening 36. Said top bore area 76 that is the space between said top side of upper piston 62 as said pistons 60, 68 move forwards or backwards and said top bore outlet opening 36. Said cylinder in-between area 78 that being the space between the bottom side of upper piston 64 and the top side of lower piston 70 as the pistons 60, 68 move forwards or backwards. The cylinder bottom area 80 being space between the bottom side of lower piston 72 as the pistons 60, 68 move forwards or backwards and the lower cylinder inlet-outlet opening 74. The combustion chamber outlet opening 34 that being the opening between said upper engine open area 12 and the combustion chamber 28. Said top bore outlet opening 36 an opening between said combustion chamber 28 and said top bore area 76. Said pistons 60, 68 move forwards or backwards within said cylinder 58 being said top bore outlet opening 36 at the top forward movement to said lower cylinder inlet-outlet opening 74 at the bottom backward movement. Said top side of upper piston 62 of said upper piston 60 would be within said top bore area 76. Said bottom side of upper piston 64 of said upper piston 60 would be within said cylinder in-between area 78 between. Said top side of lower piston 70 of said lower piston 68 would be within said cylinder in-between area 78 between. Said bottom side of lower piston 72 of said lower piston 68 would be within said cylinder bottom area 80. The rod 66 connected to the upper piston 60 and the lower piston 68, with the rod 66 connecting the pistons 60, 68 within the cylinder in-between area 78. Said bore outlet opening 90 that is the opening from said bore line 88. Said cylinder in-between area 78 that area between said pistons 60, 68 with said bore outlet opening 90, and said exhaust line inlet opening 92, within said cylinder in-between area 78. Said exhaust line inlet opening 92 that is the opening into said exhaust line 94.

Said exhaust line inlet opening 92 that is the opening between said cylinder in-between area 78 and said exhaust line 94.

Said bore inlet opening 86 that is the opening into said bore line 88. Said bore inlet opening 86 that is the opening between said cylinder bottom area 80 and said bore line 88.

Said pistons 60, 68, axially slid ably mounted therein, to reciprocate between the said combustion chamber 28 end and said cylinder bottom area 80 end within said cylinder 58. Said upper piston 60 having adjustable split said metal ca-ring 98 fitting around said upper piston 60, for stopping exploding gases entering said cylinder in-between area 78. Said lower piston 68 having adjustable split said metal cb-ring 100 fitting around said lower piston 68, for stopping compressed exhaust gases entering said cylinder in-between area 78. Said combustion chamber 28 utilizing said injector 30 would be admitting air-fuel into said combustion chamber 28. Said spark plug 32 threaded into said combustion chamber 28 delivers a spark igniting the mix. Said injector 30 with said electrical fuel pumping means not shown receives a signal from said sensor not shown measuring the inwardness of said turbine wheel 20 as rotating to determine the point for fuel pumping through said injector 30. Air-fuel inside said combustion chamber 28 explodes into exploding gases. With said head door 46 as closed and as said pistons 60, 68 forward movements toward said upper engine open area 12 within said combustion chamber 28, compressing said incoming air-fuel mix within said combustion chamber 28.

Said exploding gases within said combustion chamber 28, would then expel said exploding gases into said upper engine open area 12 from said combustion chamber 28, would then expel said exploding gases into said turbine wheel open area 24 concurrently rotating said turbine wheel 20. Said exploding gases now would be turning into compressed exhaust gases. Said compressed exhaust gases expelling into said upper engine open area 12 from said combustion chamber 28, then would expel said exploding gases into said turbine wheel open area 24 therefore concurrently rotating the already rotating said turbine wheel 20.

Said exploding gases expelling into said turbine wheel open area 24 from said upper engine open area 12, with the concurrently rotating said turbine wheel 20, now becoming compressed exhaust gases, then expelling said compressed exhaust gases into said lower engine area 18. Said compressed exhaust gases within said lower engine area 18, from said turbine wheel open area 24 that is concurrently rotating, would expel said compressed exhaust gases into said cylinder bottom area 80. Some of said compressed exhaust gases within said lower engine area 18 would expel into said cylinder bottom area 80 and some of said compressed exhaust gases would expel into said head door aa-line 38. Some of said compressed exhaust gases that expel into said cylinder bottom area 80, that is now pushing said pistons 60, 68 upward toward said combustion chamber 28. As said bore inlet opening 86 of said bore line 88 open up, by the forward movement of said pistons 60, 68, expelling said compressed exhaust gases into said bore line 88, would then expel said compressed exhaust gases into said bore outlet opening 90, would then expel said compressed exhaust gases into said cylinder in-between area 78.

Forward movement of said pistons 60, 68 opens said bore inlet opening 86 of said bore line 88 within said cylinder bottom area 80 expelling said compressed exhaust gases into said bore line 88. Forward movement of said pistons 60, 68 opens said bore outlet opening 90 of said bore line 88 within said cylinder in-between area 78, and closes said exhaust line inlet opening 92 of said exhaust line 94 within said cylinder in-between area 78, would then expel said compressed exhaust gases into said cylinder in-between area 78.

Forward movement of said pistons 60, 68 opens said bore inlet opening 86 and opens said bore outlet opening 90 of said bore line 88. Forward movement of said pistons 60, 68 closes said exhaust line inlet opening 92 of said exhaust line 94 within said cylinder in-between area 78.

Backward movement of said pistons 60, 68 toward said lower engine area 18, closes said bore inlet opening 86 of said bore line 88 within said cylinder bottom area 80 stopping said compressed exhaust gases from entering said bore line 88. Backward movement of said pistons 60, 68 closes said bore outlet opening 90 of said bore line 88 within said cylinder in-between area 78 and opens said exhaust line inlet opening 92 of said exhaust line 94 within said cylinder in-between area 78, would be expelling said compressed exhaust gases into said exhaust line 94. Forward movement of said pistons 60, 68 opens said bore inlet opening 86 and opens said bore outlet opening 90 of said bore line 88. Backward movement of said pistons 60, 68 opens said exhaust line inlet opening 92 of said exhaust line 94 within said cylinder in-between area 78.

Said compressed exhaust gases within said cylinder bottom area 80, expelling said compressed exhaust gases into said lower cylinder inlet-outlet opening 74 on the backward movement of said pistons 60, 68 toward said lower engine area 18, pushing said compressed exhaust gases into said lower engine area 18.

Upper Engine Open Area

Enclosed within said flywheel combustion engine 10, said upper engine open area 12, utilizing member including a upper engine open area outlet opening 14 that is an opening into said upper engine open area 12 and meeting with opening of the rotating a turbine wheel inlet-outlet opening 22 meeting said upper engine open area 12, said combustion chamber outlet opening 34 that is a opening into said combustion chamber 28 from said upper engine open area 12, said head door 46 would have part of lying within said upper engine open area 12 and would have part of lying within a head door open area 44, said head door 46 having a top side of head door 48 being at top side of said head door 46, said head door 46 having a bottom side of head door 50 being at bottom side of said head door 46, said door ba-line 52 having a door line inlet bb-opening 54 that is a opening into said door ba-line 52 lying within said head door open area 44, said door ba-line 52 having a door line outlet bc-opening 56 that is a opening into said upper engine open area 12, a means of controlling head door 104 that is lying between said upper engine open area 12 and said head door open area 44.

Said upper engine open area 12 mounted at periphery of said combustion chamber 28 and said turbine wheel 20. The upper engine open area 12 that being the space between the combustion chamber outlet opening 34 and the upper engine open area outlet opening 14. Said combustion chamber outlet opening 34 would be an opening into said combustion chamber 28, from said upper engine open area 12. Said combustion chamber outlet opening 34 would be an opening between said upper engine open area 12, and said combustion chamber 28.

Said head door 46 having said top side of head door 48 being at top side of said head door 46, within said upper engine open area 12. Said head door 46 having said bottom side of head door 50 being at bottom side of said head door 46, within said upper engine open area 12 as open. Said head door 46 having said bottom side of head door 50 being at bottom side of said head door 46, lying next to and on top of said combustion chamber outlet opening 34 as closed. Said head door 46 having said door ba-line 52, lying within said head door 46 and being an open line between said head door open area 44, and said upper engine open area 12. Said head door 46 having said door line inlet bb-opening 54, this is a inlet opening into said door ba-line 52 from said head door open area 44. Said head door 46 having said door line outlet bc-opening 56, this is a outlet opening from said door ba-line 52, into said upper engine open area 12. Said part of said head door 46 within said upper engine open area 12, would have said door line outlet bc-opening 56. Said part of said head door 46 within said head door open area 44, would have said door line inlet bb-opening 54. Said means of controlling head door 104 this is a means for having movement of said head door 46 within said upper engine open area 12 and for having movement of said head door 46 within said head door open area 44.

Said means of controlling head door 104 between said upper engine open area 12, and said head door open area 44, with having part of said head door 46 within said upper engine open area 12 and with having part of said head door 46 within said head door open area 44. The means of controlling head door 104 also used for stopping said compressed exhaust gases from entering into the upper engine open area 12 or entering into the head door open area 44, except into the door line inlet bb-opening 54. Said means of controlling head door 104, this would be a means for having movement of said head door 46 within said upper engine open area 12 also have movement of said head door 46 within said head door open area 44. Said head door 46 having said top side of head door 48, being at top side of said head door 46. Said head door 46 having said bottom side of head door 50, being at bottom side of said head door 46. The upper engine open area outlet opening 14 being the opening that would be lying next to the turbine wheel open area 24, within said turbine wheel 20. Said head door 46 as closed, would be lying next to said combustion chamber outlet opening 34, and would be inside said upper engine open area 12.

Said head door 46 as closed and having said pistons 60, 68 in a forward movements toward said upper engine open area 12, within said combustion chamber 28, compressing said incoming air-fuel mix within said combustion chamber 28. Said exploding gases within said combustion chamber 28, expelling said exploding gases into said upper engine open area 12, pushing said head door 46 open into said upper engine open area 12.

Said combustion chamber outlet opening 34, would be on the side of said upper engine open area 12 and mounted at periphery of said combustion chamber 28, with said combustion chamber outlet opening 34 expelling said exploding gases into said upper engine open area 12, from said combustion chamber 28. Said head door 46 lying next to said combustion chamber outlet opening 34, would be on the top of as closed and would be within said upper engine open area 12 as open. Said exploding gases expelling into said upper engine open area 12 from said combustion chamber outlet opening 34, would be pushing said head door 46 open, into said upper engine open area 12. Said head door 46 as closed would stop said compressed exhaust gases from entering back into said combustion chamber 28.

Said upper engine open area outlet opening 14 side of said upper engine open area 12 would be mounted at periphery of said turbine wheel 20. With said upper engine open area outlet opening 14, lying next to said turbine wheel inlet-outlet opening 22, would expel exploding gases into said turbine wheel open area 24 from said upper engine open area 12. Said head door 46 as open with said exploding gases from said combustion chamber 28 would be expel said exploding gases into said upper engine open area 12, then would expel said exploding gases into said turbine wheel open area 24, therefore concurrently rotating said turbine wheel 20 in a rotary motion. Said exploding gases now would be turning into compressed exhaust gases.

Said compressed exhaust gases expelling into said turbine wheel open area 24, from said upper engine open area 12 with the concurrently rotating said turbine wheel 20, would expel said compressed exhaust gases into said turbine wheel open area 24, then would expel said compressed exhaust gases into said lower engine area 18. Said compressed exhaust gases expelling into said lower engine area 18, from said turbine wheel open area 24 that is concurrently rotating, would then expel said compressed exhaust gases into said head door aa-line 38. Some of said compressed exhaust gases would be expels into said head door aa-line 38 and some of said compressed exhaust gases would be expel into said cylinder bottom area 80.

Said compressed exhaust gases expelling into said head door aa-line 38 from said lower engine area 18, would then expel said compressed exhaust gases into said head door open area 44, would then expel said compressed exhaust gases into said door ba-line 52 that lying within said head door 46. Said compressed exhaust gases expelling into said door ba-line 52 from said head door aa-line 38, would then expel said compressed exhaust gases into said door line outlet bc-opening 56, and would then expel said compressed exhaust gases into said upper engine open area 12. Said compressed exhaust gases expelling into said upper engine open area 12 from said door line outlet bc-opening 56, would be pushing on said head door 46 and closing and keeping said head door 46, onto said combustion chamber outlet opening 34. Said compressed exhaust gases coming out said door line outlet bc-opening 56 with its said compressed exhaust gases with its outward force, would be forcing said head door 46 down onto said combustion chamber outlet opening 34 and closing along with keeping said head door 46 down. With said head door 46 as closed and with said pistons 60, 68 forward movements, would start compressing said incoming air-fuel mix within said combustion chamber 28.

Turbine Wheel

Enclosed within said flywheel combustion engine 10, said turbine wheel 20, utilizing member including said turbine wheel inlet-outlet opening 22 that is an opening into said turbine wheel open area 24 rotating around meeting opening of said upper engine open area 12 and meeting opening of said lower engine area 18, said turbine wheel open area 24, a turbine wheel outer edge 26, a drive shaft 102.

Said turbine wheel 20 enclosed within said flywheel combustion engine 10 with depressions within said turbine wheel outer edge 26, these depressions around said turbine wheel outer edge 26 are called said turbine wheel open area 24. Said turbine wheel 20 is Rota ably mounted on axis called the drive shaft 102. The turbine wheel outer edge 26 that being the outer edge of and at the periphery of the upper engine open area 12. Said turbine wheel inlet-outlet opening 22 that is the opening for said upper engine open area 12. Said drive shaft 102 rotates at the center of said turbine wheel 20. Said turbine wheel open area 24 that is the space lying within said turbine wheel 20 and having said turbine wheel inlet-outlet opening 22, this opening would open into said upper engine open area 12 and open into said lower engine area 18.

These depressions being said turbine wheel open area 24, let said exploding gases expelling into said turbine wheel open area 24, concurrently rotating said turbine wheel 20 in a rotary motion. Said exploding gases expelling into said turbine wheel open area 24 from said upper engine open area 12, concurrently rotating said turbine wheel 20 in a rotary motion.

Said exploding gases now would be turning into compressed exhaust gases within said turbine wheel open area 24.

Said concurrently rotating said turbine wheel 20, with said upper engine open area 12, in a rotary motion rotate around from said upper engine open area outlet opening 14 and rotating to a lower engine inlet opening 16. Said turbine wheel 20 would in a rotary motion rotate around and around. Said upper engine open area outlet opening 14 that is the opening that open into said upper engine open area 12. The lower engine inlet opening 16 this would be the opening that open into the lower engine area 18.

Said turbine wheel 20 that is at the periphery of said upper engine open area outlet opening 14, and that is at the periphery of said lower engine inlet opening 16. Said compressed exhaust gases within said turbine wheel open area 24, concurrently rotating expelling said compressed exhaust gases into said lower engine inlet opening 16, would then expel said compressed exhaust gases into said lower engine area 18. Said drive shaft 102 rotates at the center of said turbine wheel 20 converting energy of said exploding gases into mechanical energy or work.

Lower Engine Area

Enclosed within said flywheel combustion engine 10, said lower engine area 18, utilizing member including said lower engine inlet opening 16 that is an opening into said lower engine area 18 with the rotating said turbine wheel inlet-outlet opening 22 meeting said lower engine inlet opening 16, a head door line inlet ab-opening 40 that is an opening into said head door aa-line 38 from said lower engine area 18, said lower cylinder inlet-outlet opening 74 that is an opening into said cylinder bottom area 80 from said lower engine area 18 and same opening from said cylinder bottom area 80 into said lower engine area 18.

Said lower engine area 18 mounted at periphery of said turbine wheel 20 being at said lower engine inlet opening 16, and also mounted next to said head door line inlet ab-opening 40, also mounted next said lower cylinder inlet-outlet opening 74. The lower engine area 18 that would be the space between opening of the lower engine inlet opening 16, said head door line inlet ab-opening 40, and said lower cylinder inlet-outlet opening 74.

Said compressed exhaust gases within said turbine wheel open area 24 within the concurrently rotating said turbine wheel 20 expelling these said compressed exhaust gases into said lower engine area 18.

Said compressed exhaust gases within said lower engine area 18 expelling said compressed exhaust gases into said head door line inlet ab-opening 40, then expelling said compressed exhaust gases into said head door aa-line 38.

Some of said compressed exhaust gases within said lower engine area 18 would be expel into said head door line inlet ab-opening 40 and some said compressed exhaust gases would be expel into said lower cylinder inlet-outlet opening 74.

Said compressed exhaust gases within said lower engine area 18, would expel these said compressed exhaust gases into said lower cylinder inlet-outlet opening 74 would then expel said compressed exhaust gases into said cylinder bottom area 80.

Said backward movement of said pistons 60, 68 toward said lower cylinder inlet-outlet opening 74 would be pushing said compressed exhaust gases from said cylinder bottom area 80, back into said lower engine area 18, putting added compression within said lower engine area 18. This added compression would help push said compressed exhaust gases into said head door line inlet ab-opening 40.

Said lower cylinder inlet-outlet opening 74 on the backward movement of said pistons 60, 68 toward said lower engine area 18, would be pushing said compressed exhaust gases into said lower engine area 18 from said cylinder bottom area 80. Said lower cylinder inlet-outlet opening 74 on the forward movement of said pistons 60, 68 toward said combustion chamber 28 said compressed exhaust gases from said lower engine area 18 would expel into said cylinder bottom area 80. Said compressed exhaust gases that is expelling into said cylinder bottom area 80 would be pushing said pistons 60, 68 forward toward said top bore area 76.

Head Door aa-line

Enclosed within said flywheel combustion engine 10, said head door aa-line 38, utilizing member including said head door line inlet ab-opening 40 that is a opening from said lower engine area 18 into said head door aa-line 38, a head door line outlet ac-opening 42 that is a opening from said head door aa-line 38 into said head open area 44, said head open area 44 that is an open area for said head door 46 to have movement in and is for said door line inlet bb-opening 54 to have an opening in. The means of controlling head door 104 between the upper engine open area 12 and the head door open area 44. Said head door 46 would have part of lying within said upper engine open area 12 and would have part of lying within said head door open area 44. The door line inlet bb-opening 54 lying within said head door 46 that would be the opening between the head door open area 44 and the door ba-line 52. Said head door aa-line 38 would be a pipe for conveying said compressed exhaust gases from said lower engine area 18 into said line inlet bb-opening 54 then into said upper engine open area 12.

Said compressed exhaust gases within said lower engine area 18 would then expel into said head door line inlet ab-opening 40, would then said compressed exhaust gases into said head door aa-line 38. Said compressed exhaust gases within said head door aa-line 38 expelling into said head door line outlet ac-opening 42, would then expel said compressed exhaust gases into said into said head door open area 44. Said compressed exhaust gases within said head door open area 44 expelling into said door line inlet bb-opening 54, would then expel said compressed exhaust gases into said into said door ba-line 52. Said compressed exhaust gases within said door ba-line 52 expelling into said door line outlet bc-opening 56, would then expel said compressed exhaust gases into said upper engine open area 12. Said compressed exhaust gases coming out said door line outlet bc-opening 56 within said head door 46, expelling into said upper engine open area 12, would be pushing said head door 46 down and closing said head door 46 onto said combustion chamber outlet opening 34.

Said means of controlling head door 104 between said upper engine open area 12 and said head door open area 44, said head door 46 would have part of lying within said upper engine open area 12 and would have part of lying within said head door open area 44. The means of controlling head door 104 that is also used for stopping said compressed exhaust gases from entering into the upper engine open area 12 or entering into the head door open area 44, except into the door line inlet bb-opening 54. Said means of controlling head door 104, this would be a means for having movement of said head door 46 within said upper engine open area 12 also have movement of said head door 46 within said head door open area 44. Said part of said head door 46 within said upper engine open area 12 has said door line outlet bc-opening 56. Said part of said head door 46 within said head door open area 44 has said door line inlet bb-opening 54.

Bore Line

Enclosed within said flywheel combustion engine 10, said bore line 88, said bore inlet opening 86 that is an opening into said bore line 88 from said cylinder bottom area 80, said bore outlet opening 90 that is an opening from said bore line 88 into said cylinder in-between area 78.

Said bore line 88 this is a pipe for conveying said compressed exhaust gases from said cylinder bottom area 80 into said cylinder in-between area 78. Said bore line 88 mounted at periphery of said cylinder 58, with said bore inlet opening 86 connected to said cylinder bottom area 80 of said cylinder 58 and said bore outlet opening 90 that is connected to said cylinder in-between area 78 of said cylinder 58.

Some of said compressed exhaust gases that expel into said cylinder bottom area 80, that is now pushing said pistons 60, 68 upward toward said combustion chamber 28. As said bore inlet opening 86 of said bore line 88 open up, by the forward movement of said pistons 60, 68, expelling said compressed exhaust gases into said bore line 88, would then expel said compressed exhaust gases into said bore outlet opening 90, would then expel said compressed exhaust gases into said cylinder in-between area 78.

Forward movement of said pistons 60, 68 opens said bore inlet opening 86 of said bore line 88 within said cylinder bottom area 80, would then expel said compressed exhaust gases into said bore line 88. Forward movement of said pistons 60, 68 opens said bore outlet opening 90 of said bore line 88 within said cylinder in-between area 78, and closes said exhaust line inlet opening 92 of said exhaust line 94 within said cylinder in-between area 78, would then expel said compressed exhaust gases into said cylinder in-between area 78.

Forward movement of said pistons 60, 68 opens said bore inlet opening 86, and opens said bore outlet opening 90 of said bore line 88. Forward movement of said pistons 60, 68 closes said exhaust line inlet opening 92 of said exhaust line 94, within said cylinder in-between area 78.

Backward movement of said pistons 60, 68 toward said lower engine area 18, closes said bore inlet opening 86 of said bore line 88 within said cylinder bottom area 80, stopping said compressed exhaust gases from entering said bore line 88. Backward movement of said pistons 60, 68 closes said bore outlet opening 90 of said bore line 88 within said cylinder in-between area 78 and opens said exhaust line inlet opening 92 of said exhaust line 94 within said cylinder in-between area 78, would be expelling said compressed exhaust gases into said exhaust line 94. Forward movement of said pistons 60, 68 opens said bore inlet opening 86 and opens said bore outlet opening 90 of said bore line 88. Backward movement of said pistons 60, 68 opens said exhaust line inlet opening 92 of said exhaust line 94 within said cylinder in-between area 78.

Exhaust Line

The flywheel combustion engine 10, with the exhaust line 94 mounted on and connected to the cylinder 58. Said exhaust line 94 utilizing member including said exhaust line inlet opening 92 that is an opening into said exhaust line 94 from said cylinder in-between area 78, said exhaust line outlet opening 96 that is an opening from said exhaust line 94 and exhausting said exhaust gases out said flywheel combustion engine 10.

Said exhaust line 94 begin a pipe for conveying the exhaust expansion gases from said exhaust line inlet opening 92 to said exhaust line outlet opening 96. Said exhaust line inlet opening 92, for expelling said compressed exhaust gases that is within said cylinder in-between area 78, then expelling said compressed exhaust gases into said exhaust line 94. Said compressed exhaust gases now would be turning into exhaust gases. Said exhaust line outlet opening 96 for expelling said compressed exhaust gases that is within said exhaust line 94, would then expel said exhaust gases out of said flywheel combustion engine 10.

Forward movement of said pistons 60, 68 would close up said exhaust line inlet opening 92 of said exhaust line 94 within said cylinder in-between area 78. Backward movement of said pistons 60, 68 would open up said exhaust line inlet opening 92 of said exhaust line 94 within said cylinder in-between area 78.

Forward movement of said pistons 60, 68 would open up said bore outlet opening 90 of said bore line 88 within said cylinder in-between area 78, and would close up said exhaust line inlet opening 92 within said cylinder in-between area 78.

Backward movement of said pistons 60, 68 would close up said bore outlet opening 90 of said bore line 88 within said cylinder in-between area 78, and would open up said exhaust line inlet opening 92 within said cylinder in-between area 78.

Ramifications of Detailed Description

The foregoing discussion and claims that follow describe only preferred embodiments of present invention. These embodiments particularly with respect to the claims. Understood a number of changes might be made without departing from essence present invention. It is intended that such changes substantially achieve the same results. Substantially same way will still fall within scope of the present invention.

It is not practical to describe in claims all possible embodiments. Embodiments may be accomplished generally in keeping with present invention. Disclosure may include separately or collectively aspects described found throughout description of patent. While these may be added to explicitly include such details. Existing claims should be construed to encompass such aspects. To the extent methods claimed in present invention are not further discussed. Any extent methods are natural outgrowths of the system or apparatus claims. Therefore, separate and further discussions of the methods are deemed unnecessary. Otherwise claim steps implicit in use and manufacture of system or apparatus claims. Furthermore, steps organized in logical fashion and other sequences can and do occur. Therefore, method claims should not be construed to include only this order. Other order and sequence steps may be presented.

Furthermore, any references mentioned in the application for this patent as well as all references listed. That all and any information disclosure originally filed with the application is hereby incorporated. That all reference in their entirety to the extent such may be deemed essential. That all supports ennoblement of the invention(s). However, to the extent statements might be considered inconsistent with the patenting of this/these invention(s). Any such statements are expressly not to be considered as made by the applicant.

Notice: Subject to any disclaimer, the term of this patent is extended or adjusted under 35 U.S.C. 154(b) by 0 days.

I claim:

1. A flywheel combustion engine comprising a combustion chamber mounted at the periphery of an upper engine open area, a head door for opening and closing said combustion chamber being mounted within said upper engine open area, said combustion chamber being also mounted at the periphery of a turbine wheel enclosed within said flywheel combustion engine, said turbine wheel mounted at the periphery of said upper engine open area and at the periphery of a lower engine area, said turbine wheel is rotatably mounted on an axis of a drive shaft, said lower engine area being also mounted at the periphery of a cylinder bottom area, a head door line located between said lower engine area and said upper engine open area, said combustion chamber communicating at the combustion end thereof with said upper engine open area and said turbine wheel, an upper piston being connected with a lower piston by a piston rod, said upper piston being at combustion end of said cylinder, a lower piston axially mounted inside said cylinder bottom end, said pistons reciprocating between said cylinder bottom area end and combustion end of said combustion chamber, said pistons defining a cylinder in-between area between said pistons, said cylinder bottom area end having a bore line communicating with said cylinder in-between area, a control apparatus having automatic timing sequence for driving of said flywheel combustion engine; closing said head door to form a closed combustion chamber and advancing said pistons to the combustion end thereof, feeding air-fuel mixture into said combustion chamber end thereof after the advancing of said pistons, igniting said mixture to drive said pistons backward, opening said closed combustion chamber by opening said head door into said upper engine open area then expelling the combustion gases into said upper engine open area then against said turbine wheel to concurrently driving said turbine wheel, then expelling the combustion gases into said lower engine area, said lower engine area expelling the combustion gases into said cylinder bottom area end, then expelling the combustion gases into said head door line, pushing the combustion gases into said head door line back to said upper engine open area therefore closing said head door onto the combustion chamber outlet opening of said combustion chamber, and also pushing said combustion gases into said cylinder bottom area end onto said lower piston for further advancing said pistons forward, advancing of said pistons and opening up a bore inlet opening in said cylinder bottom area end and then opening up a bore outlet opening in said cylinder in-between area between said upper piston and said lower piston, advancing of said pistons forward opening up said bore outlet opening into said cylinder in-between area with said pistons exhausting the combustion gases into said cylinder in-between area from said cylinder bottom area end, combustion gases driving said pistons backward and closing said bore outlet opening and opening up said exhaust line inlet opening to an exhaust line and exhausting the combustion gases that in said cylinder in-between area expelling out the combustion gases of said flywheel combustion engine, the combustion gases driving said pistons forward compressing air-fuel mixture and input the resultant of said combustion chamber to recommend the combustion exhaust cycle thereat.

2. An automatic cycle self-timing flywheel combustion engine comprising: a combustion chamber mounted at the periphery of an upper engine open area with an outlet opening communicating with said upper engine open area, an upper piston inside said combustion chamber mounted in close sliding engagement with the walls of a cylinder, so as to slide back and forth within said cylinder;

said upper engine open area mounted at the periphery of said combustion chamber and also mounted in close engagement at the periphery of a turbine wheel, the combustion chamber outlet opening discharging combustion gas into said upper engine open area from said combustion chamber, and communicating at the combustion end thereof with a head door, said head door being able to open and close in response to the position of said upper piston, said upper piston being positioned for urging said upper piston against the combustion end to open said head door, and said upper piston can also be positioned for urging said upper piston against the lower side of combustion chamber to close said head door, and communicating at the combustion end of said combustion chamber thereof with said turbine wheel, means for opening and feeding a fuel air mixture therein when said piston has moved against the combustion end and closed said combustion chamber by the closing of said head door, means for igniting the mixture driving said piston away and opening said head door and expelling the combustion gases from said combustion chamber and into said upper engine open area, then into a turbine wheel open area, and automatically recommending the combustion exhaust cycle;

said rotatably turbine wheel having depressions around the turbine wheel outer edge forming said turbine wheel open area and mounted in close engagement at the periphery of said upper engine open area, and also mounted in close engagement at the periphery of said lower engine area, for communicating at the combustion end of said combustion chamber thereof with said turbine wheel, in the direction of rotation of said turbine wheel; said lower engine area mounted in close engagement at the periphery of said turbine wheel and mounted at the periphery of said cylinder and communicating at the combustion end of said combustion chamber and mounted to said lower engine area and mounted and connected to a head door as-line;

said head door aa-line is mounted and connected to said lower engine area and said upper engine open area for communicating at the combustion end of said combustion chamber;

said cylinder mounted at the periphery of said lower engine area end at the periphery of said upper engine open area, having therein said upper piston and a lower piston mounted in close sliding engagement with the walls of said cylinder, so as to slide back and forth within said cylinder, and having a rod connecting said upper piston to said lower piston and defining a cylinder in-between area, a bore line mounted and connected to said cylinder bottom area, said bore line being also mounted and connected to said cylinder in-between area, said pistons being positioned for being urged against the combustion end to open a bore inlet opening within said cylinder bottom area, and said pistons being positioned for being urged against the combustion end to open a bore outlet opening and close the exhaust line inlet opening within said cylinder in-between area, said pistons being positioned for being urged against the cylinder bottom area to close the bore inlet opening within said cylinder bottom area, said pistons can also be positioned for being urged against the combustion end to close the bore outlet opening and open the exhaust line inlet opening within said cylinder in-between area;

said bore line mounted and connected to said cylinder bottom area and to said cylinder in-between area for communicating at the combustion end of said combustion chamber, said pistons being positioned for being urged against the combustion end to open said bore inlet opening within said cylinder bottom area, and said pistons being positioned for being urged against the combustion end to open said bore outlet opening within said cylinder in-between area, and said pistons being positioned for being urged against said cylinder bottom area to close the bore inlet opening within said cylinder bottom area, and said pistons being positioned for being urged against the combustion end to close said bore outlet opening within said cylinder in-between area;

said exhaust line mounted and connected to said cylinder in-between area and communicating at the combustion end of said combustion chamber, and said pistons being positioned for being urged against the combustion end to close said exhaust line inlet opening within said cylinder in-between area, and said pistons positioned for being urged against said cylinder bottom area to open said exhaust line inlet opening within said cylinder in-between area, said exhaust line having the exhaust line outlet opening.

3. The flywheel combustion engine claim 2 wherein said combustion chamber is positioned normal to said upper engine open area.

4. The flywheel combustion engine of claim 2 wherein the fuel air mixture is compressed between said upper piston and said head door.

5. The flywheel combustion engine of claim 2 wherein said combustion chamber outlet opening is a part of said combustion chamber.

6. The flywheel combustion engine of claim 2 wherein said upper engine open area having said head door positioned normal to said combustion chamber.

7. The flywheel combustion engine of claim 2 wherein said head door is inside said upper engine open area.

8. The flywheel combustion engine of claim 2 wherein said upper engine open area is positioned normal to said turbine wheel.

9. The flywheel combustion engine of claim 2 wherein the combustion gases being expelled into said turbine wheel open area from said upper engine open area.

10. The flywheel combustion engine of claim 2 wherein the combustion gases being expelled into said lower engine area from said turbine wheel open area.

11. The flywheel combustion engine of claim 2 wherein some of combustion gases being expelled into the head door aa-line from said lower engine area and some combustion gases being expelled into said cylinder bottom area from said lower engine area.

12. The flywheel combustion engine of claim 2 wherein the combustion gases being expelled into said upper engine open area from said head door aa-line.

13. The flywheel combustion engine of claim 2 wherein the combustion gases being expelled into said bore line from said cylinder bottom area.

14. The flywheel combustion engine of claim 2 wherein the combustion gases being expelled into said cylinder in-between area from said bore line for driving the pistons axially.

15. The flywheel combustion engine of claim 2 wherein the combustion gases expelling into said exhaust line from said cylinder in-between area after driving the pistons.

16. The flywheel combustion engine of claim 2 wherein said cylinder in-between between area between said pistons and having said bore outlet opening and said exhaust line inlet opening within said cylinder in-between area.

17. The flywheel combustion engine of claim 2 wherein the combustion gases expel into said exhaust line inlet opening from said cylinder in-between area.

18. The flywheel combustion engine of claim 2 wherein the combustion gases expel onto said lower piston therefore advancing said pistons forward opening up said bore inlet opening in said cylinder bottom area end, and advancing said pistons forward opening up said bore outlet opening within said cylinder in-between area and closing up said exhaust line inlet opening within said cylinder in-between area.

19. The flywheel combustion engine of claim 2 wherein the combustion gases flow onto said upper piston therefore advancing said pistons backward for closing up said bore inlet opening in said cylinder bottom area end, and advancing of said pistons backward dosing up said bore outlet opening within said cylinder in-between area and opening up said exhaust line inlet opening within said cylinder in-between area.

* * * * *